US007261187B2

(12) United States Patent
Fischer et al.

(10) Patent No.: US 7,261,187 B2
(45) Date of Patent: Aug. 28, 2007

(54) DEFLECTING MODULE FOR ELEVATOR

(75) Inventors: Daniel Fischer, Ollon (CH); Heinrich Kuttel, Weggis (CH)

(73) Assignee: Inventio AG, Hergiswil NW (CH)

( * ) Notice: Subject to any disclaimer, the term of this patent is extended or adjusted under 35 U.S.C. 154(b) by 0 days.

(21) Appl. No.: 11/419,223

(22) Filed: May 19, 2006

(65) Prior Publication Data

US 2006/0260879 A1 Nov. 23, 2006

(30) Foreign Application Priority Data

May 19, 2005 (EP) ..... 05104228

(51) Int. Cl.
*B66B 7/10* (2006.01)

(52) U.S. Cl. ..... 187/412; 187/264

(58) Field of Classification Search ..... 187/266, 187/264, 412; *B66B 7/10, 11/08*
See application file for complete search history.

(56) References Cited

U.S. PATENT DOCUMENTS 1,915,486 A * 6/1933 Frost ..... 187/412
7,077,241 B1 * 7/2006 Liebetrau et al. ..... 187/266
2004/0154876 A1 * 8/2004 Choi ..... 187/412

FOREIGN PATENT DOCUMENTS

| | | |
|---|---|---|
| CA | 2 512 037 | 1/2006 |
| DE | 1 208 463 | 1/1966 |
| DE | 23 33 120 | 1/1975 |
| DE | 198 39 864 | 8/1999 |
| EP | 1 621 508 | 2/2006 |
| WO | WO 2004/069715 | 8/2004 |

* cited by examiner

*Primary Examiner*—Gene O Crawford
*Assistant Examiner*—Stefan Kruer
(74) *Attorney, Agent, or Firm*—Fraser Clemens Martin & Miller LLC; William J. Clemens

(57) ABSTRACT

A deflecting module has deflecting elements that are displaceable relative to one another. The deflecting elements are mutually supported, wherein at each side the outermost deflecting element is carried by a bearing plate. Each deflecting element has a housing which carries an axle and, for the mutual displaceability, has on one side a groove and on the other side a cog. A deflecting roller is rotatably arranged on the axle for guiding and deflecting elevator car and counterweight support elements, for example a flat belt, and producing a change of direction of the support elements.

13 Claims, 8 Drawing Sheets

DEFLECTING MODULE FOR ELEVATOR

BACKGROUND OF THE INVENTION

The present invention relates to a deflecting module for an elevator for deflection of support means supporting an elevator car and a counterweight, wherein the support means are guided by way of deflecting rollers producing a change in direction of the support means.

A deflecting module with two deflecting rollers is shown in the published German specification DE 23 33 120, wherein each roller deflects a flat support means supporting an elevator car and a counterweight. One roller is fixedly connected with a rotatable axle carried by a bracket. The other roller is rotatably arranged at the axle.

A disadvantage of this known equipment is that in the case of several rollers arranged adjacent to one another the deflecting module has a very wide construction and is not usable in every case when there are narrow shaft conditions.

SUMMARY OF THE INVENTION

The present invention meets the objective of avoiding the disadvantages of the known equipment and of creating equipment adaptable to the shaft conditions.

The advantages achieved by the present invention include that space-saving elevator configurations can be realized with the deflecting module, according to the present invention, provided with several deflecting elements, particularly in the case of belts as support means. It is additionally advantageous that the deflecting module can be easily exchanged and is thus usable for different shaft cross-sections. New drives with new and newly guided support means (for example flat belts) can be readily incorporated in existing elevator installations (modernizations). It is additionally advantageous that, with the arrangement of the deflecting module according to the present invention over the longitudinal axis of the counterweight projection, diagonal tension and twisting of the support means can be prevented, which in turn has a positive effect on the service life of the support means.

In the case of the deflecting module according to the present invention for an elevator for deflection of support means supporting an elevator car and a counterweight the support means are guided over deflecting rollers which produce a change in direction of the support means, wherein a respective deflecting element, at which at least one axle for rotatable mounting of at least one deflecting roller is arranged, is provided for each support means.

DESCRIPTION OF THE DRAWINGS

The above, as well as other, advantages of the present invention will become readily apparent to those skilled in the art from the following detailed description of a preferred embodiment when considered in the light of the accompanying drawings in which.

DESCRIPTION OF THE PREFERRED EMBODIMENT

Figure 1:
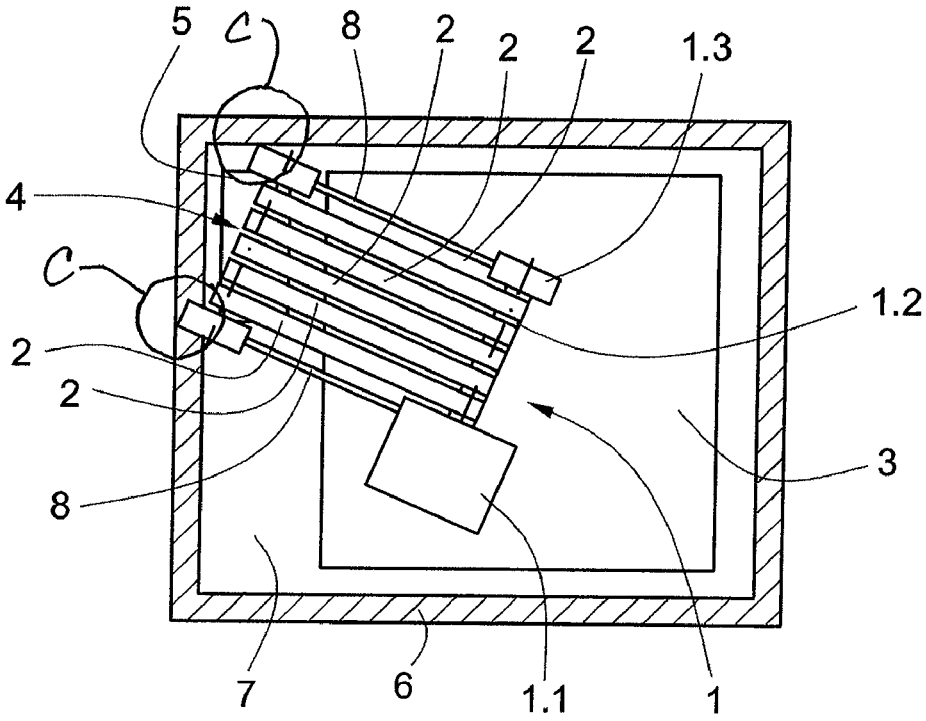
FIG. 1 (PRIOR ART)
FIG. 1 is a cross-sectional plan view of a prior art drive unit with a flat belt as a support means and a deflecting module of the conventional kind.

FIG. 1 shows a drive unit 1 with a motor 1.1, a drive pulley 1.2 and a brake 1.3, wherein the drive pulley 1.2 drives flat belts 2 as a support means having multiple support elements. The middle of the drive pulley 1.2 lies approximately in the center of projection of an elevator car 3. The flat belts 2 are guided by way of a prior art conventional deflecting module 4. The middle of the deflecting module 4 lies approximately in the center of projection of a counterweight 5. The elevator car 3 and the counterweight 5 are supported by the flat belts 2 and are movable by means of the flat belts 2 in an elevator shaft 7 bounded by shaft walls 6. The deflecting module 4 and the drive unit 1 are mutually supported by means of rods 8.

Encircled locations C in FIG. 1 show a conflict or interference of the deflecting module 4 with the shaft wall 6 in the case of an inclined arrangement or in the case of arrangement of a counterweight 5 in the shaft corner. The corners of the conventional deflecting module 4 collide with the adjacent shaft walls 6. The only remedy was to form costly recesses in the shaft wall 6.

Figure 2:
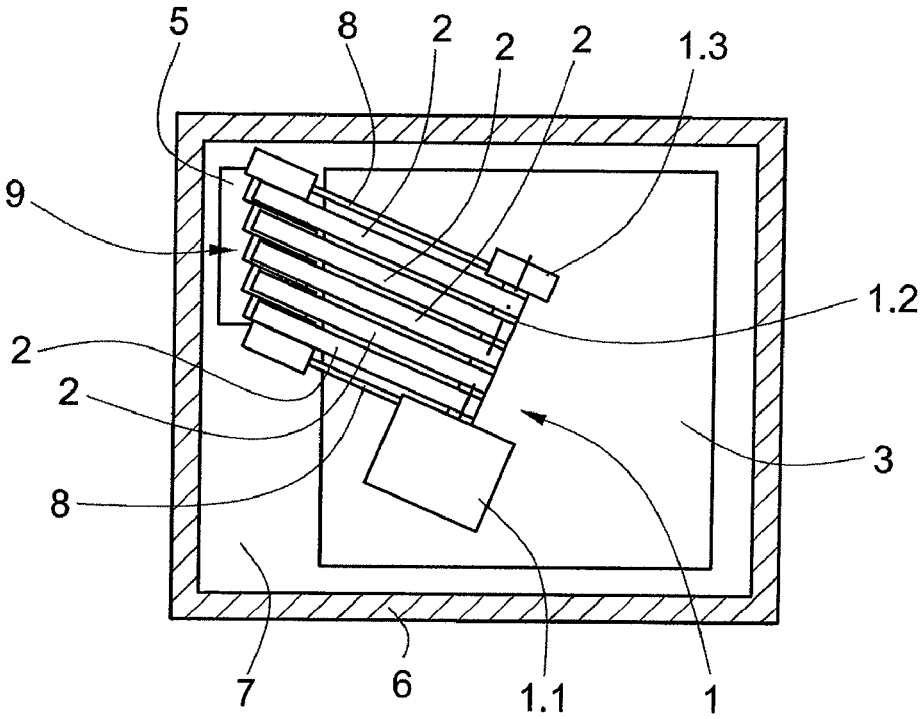
FIG. 2 is a plan view similar to FIG. 1 of a drive unit with a flat belt as a support means and a deflecting module according to the present invention.

FIG. 2 is a view similar to FIG. 1 that shows a deflecting module 9 according to the present invention which is adaptable to different space conditions. The flat belts 2 used as the support means are deflected approximately over the longitudinal axis of the counterweight projection.

Figure 3:
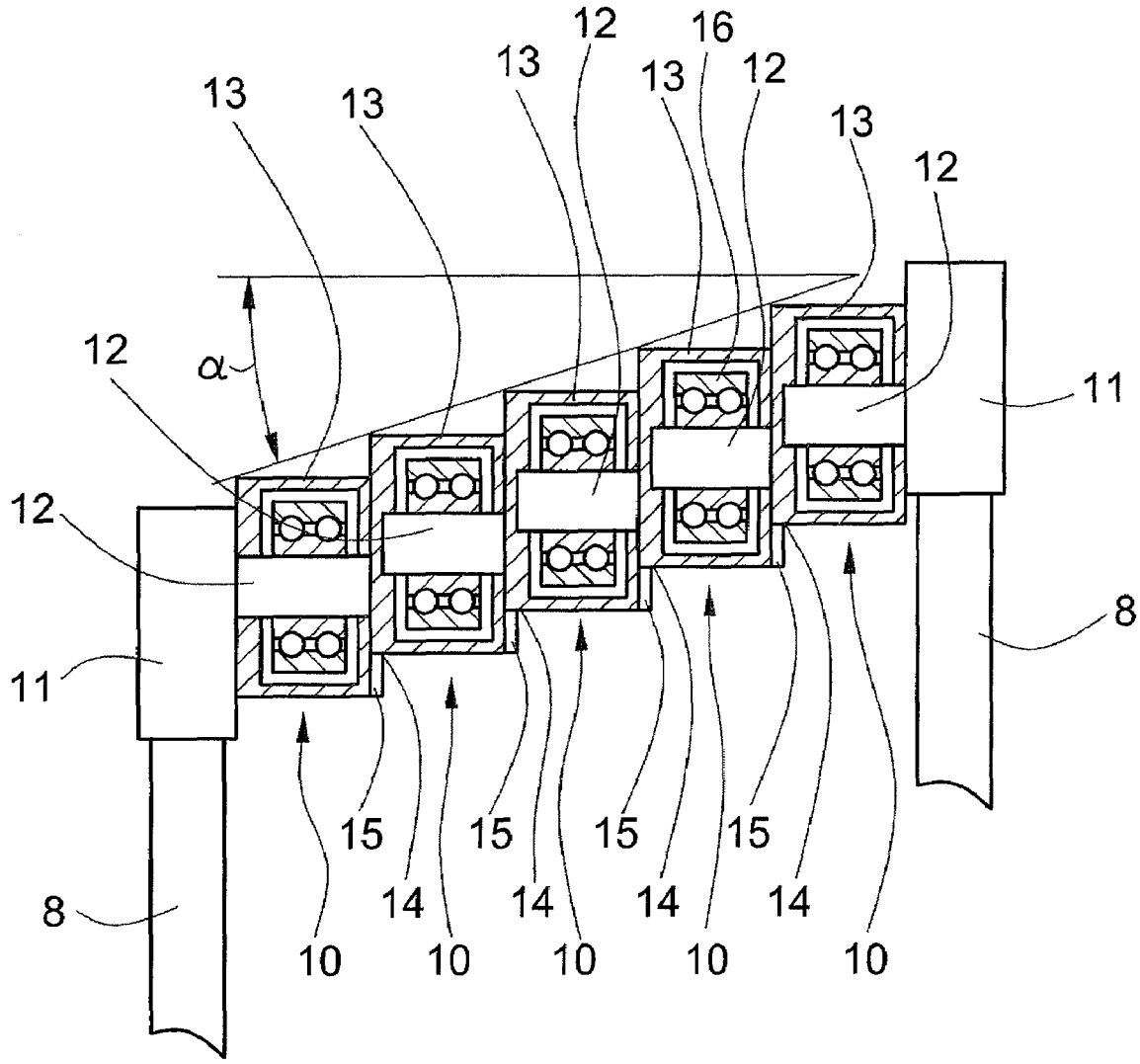
FIG. 3 is a fragmentary enlarged schematic illustration of the deflecting module shown in FIG. 2.

FIG. 3 is a schematic illustration of the deflecting module 9 according to the present invention, wherein deflecting elements 10 are displaceable relative to one another. The deflecting elements 10 are mutually supported, wherein at each side the outermost deflecting element 10 is carried by a bearing plate 11. The maximum achievable—by the mutual displaceability of the deflecting elements 10—angle relative to the rectangular construction of the conventional deflecting module 4 is denoted by $\alpha$. Each of the deflecting elements 10 substantially consists of a housing 13 which carries an axle 12 and which for mutual displaceability has on one side a groove 14 and on the other side a cog 15. Rotatably arranged at the axle 12 is a deflecting roller 16 which is suitable for guiding and deflecting the support means, for example the flat belt 2, or producing a change in the direction of the flat belt 2 of, for example, 90°. A wedge-ribbed belt or a cogged belt or a cable can also be provided as the support elements of the support means. As shown in FIGS. 4 to 7, base plates 28 ensure, in accordance with the principle of a parallelogram, that each of the deflecting elements 10 or the housing 13 is displaceable by the same distance relative to the adjacent deflecting element 10 or housing 13.

Figure 4:
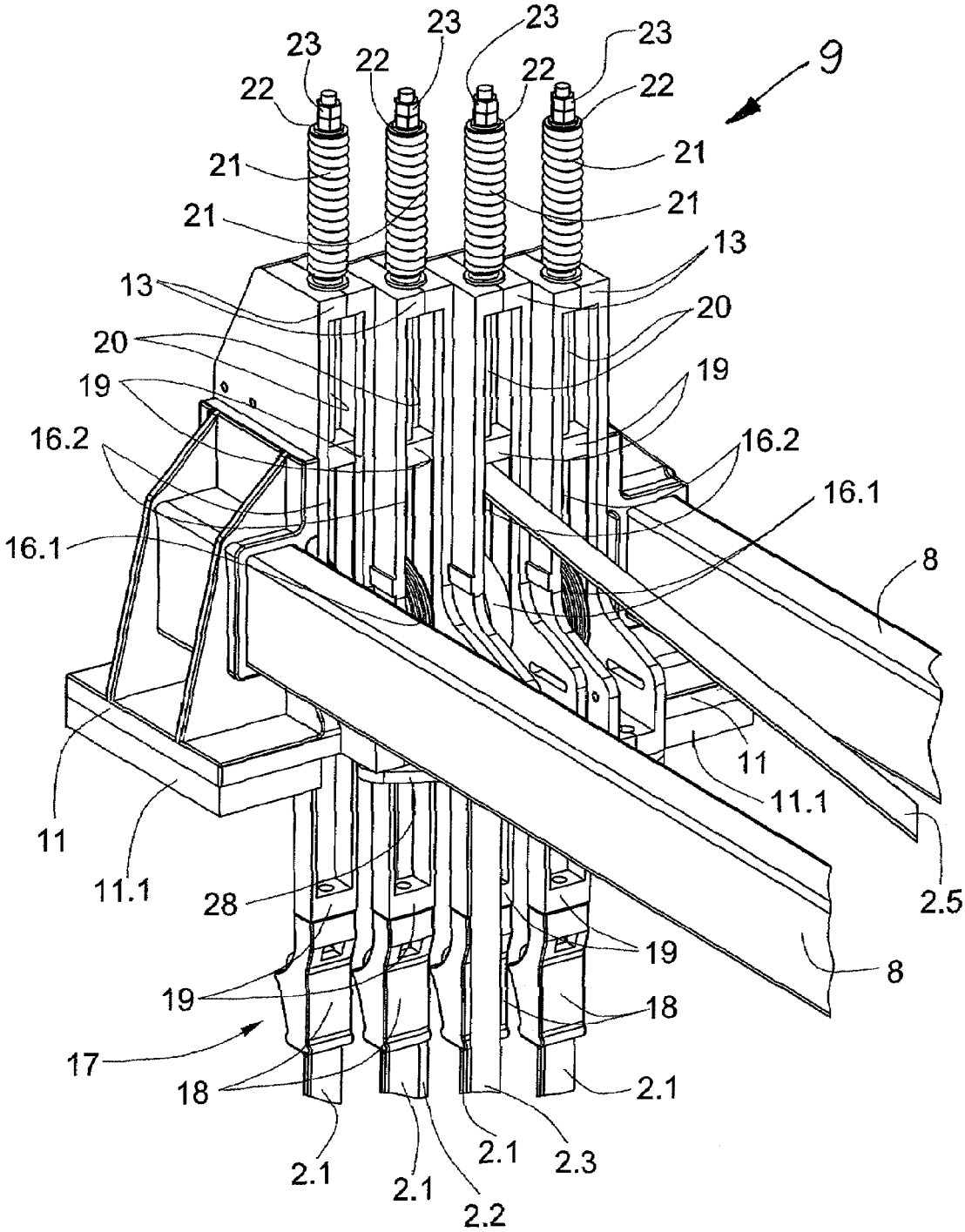
FIG. 4 is a perspective view of the deflecting module shown in FIG. 2 with integrated support means fixing points.
Figure 5:
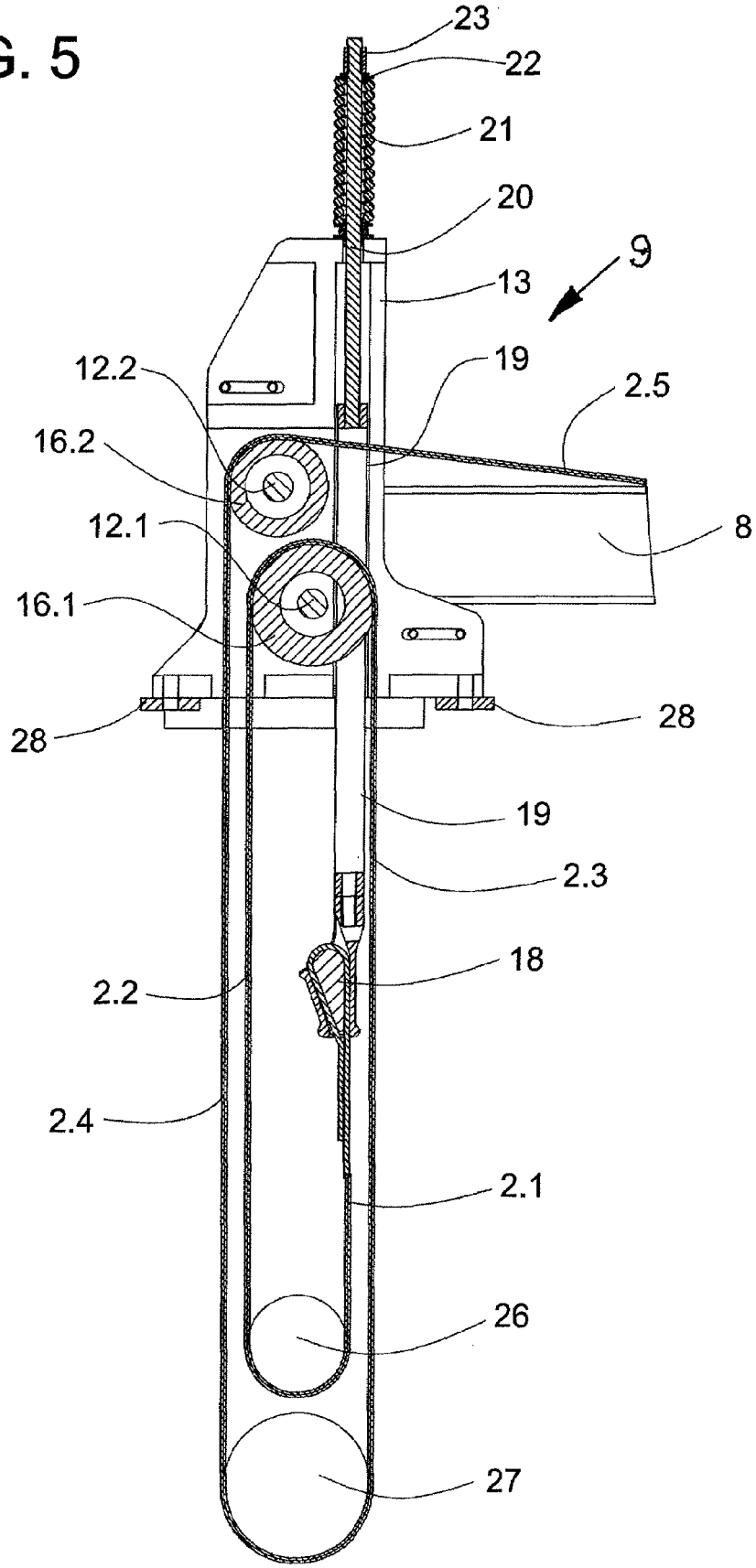
FIG. 5 is a cross-sectional view through a deflecting element of the deflecting module shown in FIG. 4 for a 4:1 support means guidance.

FIG. 4 is a perspective illustration of the deflecting module 9 according to the present invention with integrated support means fixing points 17 for a 4:1 support means guidance. Each of the bearing plates 11 is connected with the respective rod 8, wherein the bearing plate 11 rests on a vibration damper 11.1 and this in turn on a bracket (not illustrated). The support means fixing point 17 substantially consists of a support means end connection 18, a yoke 19, a threaded pin 20 and a compensating spring 21. The support means end connection 18 fixes the end of the support means 2. The bracket 19, which penetrates the box-like housing 13 of the deflecting element 10, is connected at one end with the support means end connection 18 and at the other end with the threaded pin 20. The compensating spring 21 is supported at one end at the housing 13 and at the other end the threaded pin 20 is supported by means of washers 22 and nuts 23 at the compensating spring 21. A first deflecting roller 16.1 with an axle 12.1 and a second deflecting roller 16.2 with axle 12.2 are necessary at the deflecting module 9 for a 4:1 support means guidance, wherein the support means 2, as shown in FIG. 5, is guided from the support means end connection 18 as a run 2.1 on a first deflecting roller 26 of the counterweight 5, then as a run 2.2 on the first deflecting roller 16.1 of the deflecting module 9, further as a run 2.3 on a second deflecting roller 27 of the counterweight 5, further as a run 2.4 on the second deflecting roller 16.2 of the deflecting module 9 and further as a run 2.5 on the drive pulley 1.2. The support means 2 and the first deflecting roller 16.1 penetrate the yoke 19 of the support means fixing point 17.

FIG. 5 shows a cross-section through one of the deflecting elements 10 of the deflecting module 9 for the above-mentioned 4:1 support means guidance.

Figure 6:
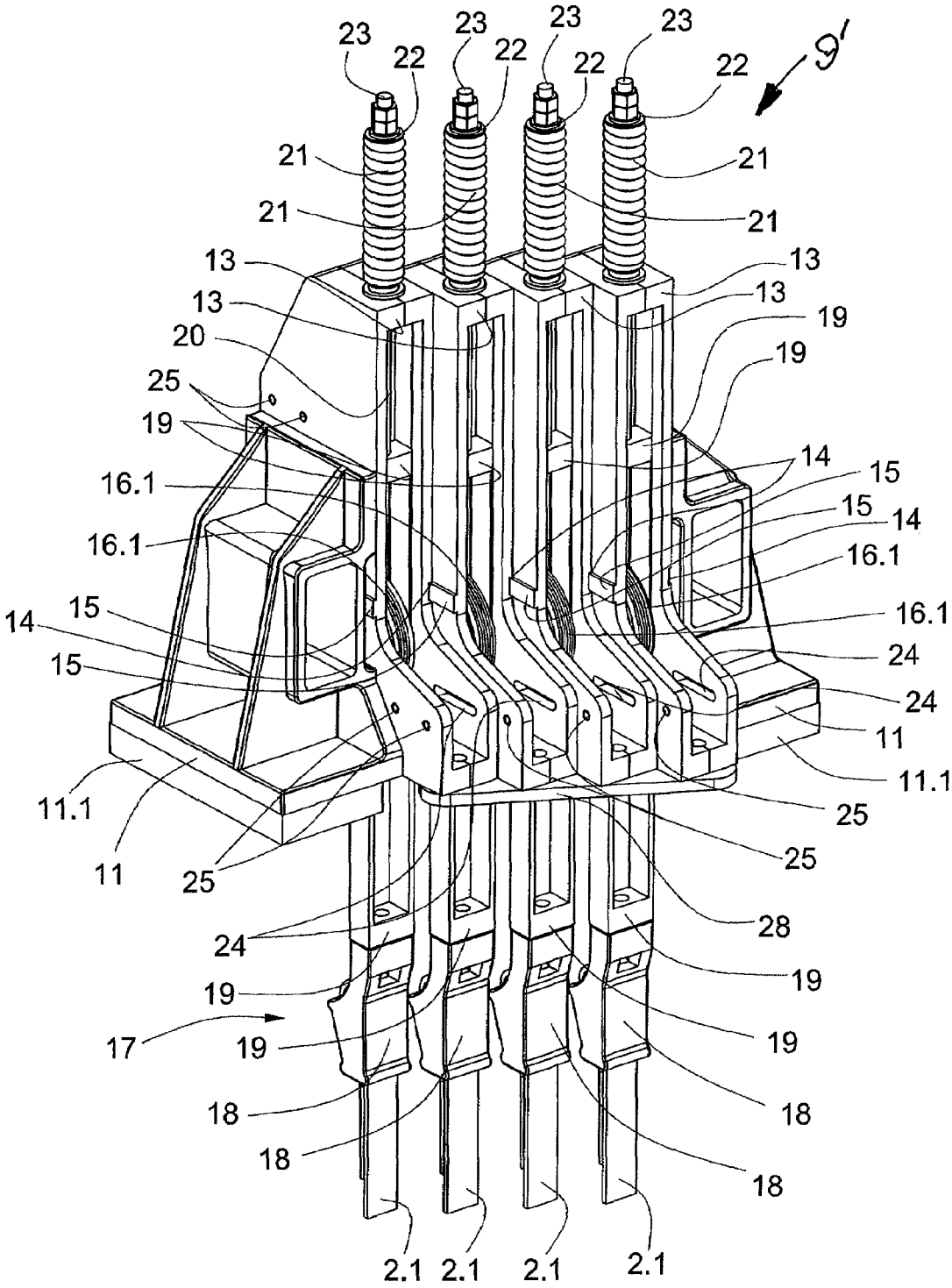
FIG. 6 is a perspective view of an alternative embodiment deflecting module according to the present invention for a 2:1 support means guidance.

FIG. 6 shows a perspective illustration of an alternate embodiment deflecting module 9' according to the present invention for a 2:1 or 1:1 support means guidance. The second deflecting roller 16.2 of the deflecting module 9 and the second deflecting roller 27 of the counterweight 5 or of the elevator car 3 are redundant in the case of 2:1 support means guidance. Apart from the absent second deflecting roller 16.2, the construction of the deflecting module 9' is identical with that of the 4:1 support means guidance of FIGS. 4 and 5. The support means 2 is guided from the support means end 3 0 connection 18 as the run 2.1 on the first deflecting roller 26 of the counterweight 5, then as the run 2.2 on the first deflecting roller 16.1 of the deflecting module 9' and then on the drive pulley 1.2. In the case of a 1:1 support means guidance the support means fixing points 17 and the deflecting rollers at the counterweight 5 and the drive pulley 3 are redundant.

Apart from the groove 14 and the cog 15 the deflecting element 10 has on one side a slot 24 and on the other side bores 25. Screws (not shown) penetrate the bores 25 and the slots 24 and firmly hold each two adjacent ones of the deflecting elements 10 together. The mutual displaceability of the deflecting elements 10 is ensured by means of the slots 24.

Figure 7:
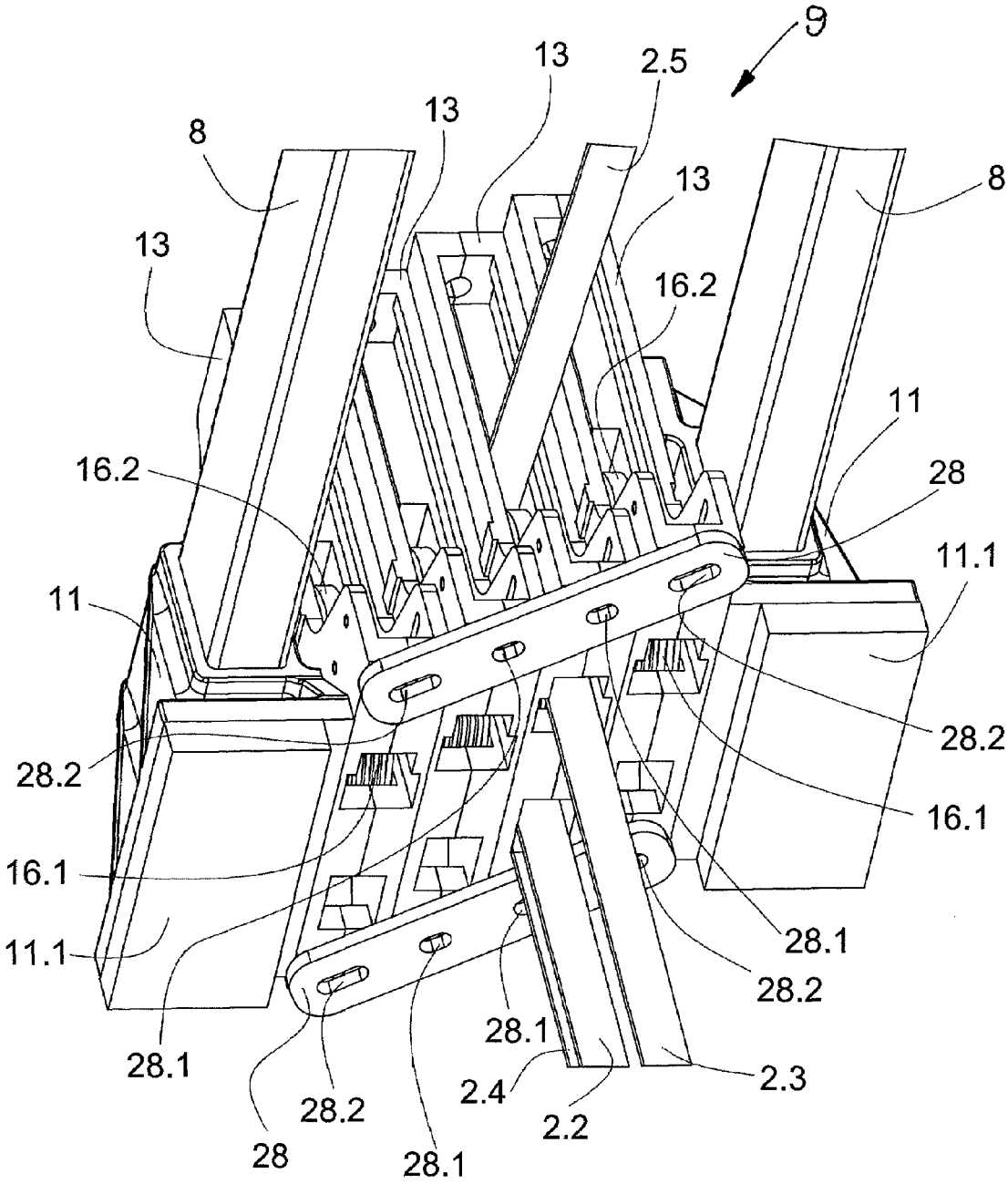
FIG. 7 is a perspective view of the deflecting module shown in FIG. 4 as seen from below.

FIG. 7 shows the deflecting module 9 according to the present invention as seen from below, wherein each of the deflecting elements 10 or each of the housings 13 is connectible at each narrow side with the base plate 28. The base plate 28 has two center slots 28.1 and two outer slots 28.2. The center slots 28.1 are half as long as the outer slots 28.2. Not illustrated are connecting means, for example screws, which penetrate the slots 28.1, 28.2 and bores 29 (FIG. 8) arranged at the housing 13 and detachably connect the base plates 28 with the housings 13. The base plates 28 ensure, in accordance with the principle of a parallelogram, that each one of the deflecting elements 10 or the housings 13 is displaceable by the same distance relative to the adjacent one of the deflecting elements 10 or the housing 13. In FIG. 7 the base plates 28 together with the deflecting elements 10 form a parallelogram. Without displacement of the deflecting elements 10, the base plates 28 together with the deflecting elements 10 form a rectangle.

Figure 8:
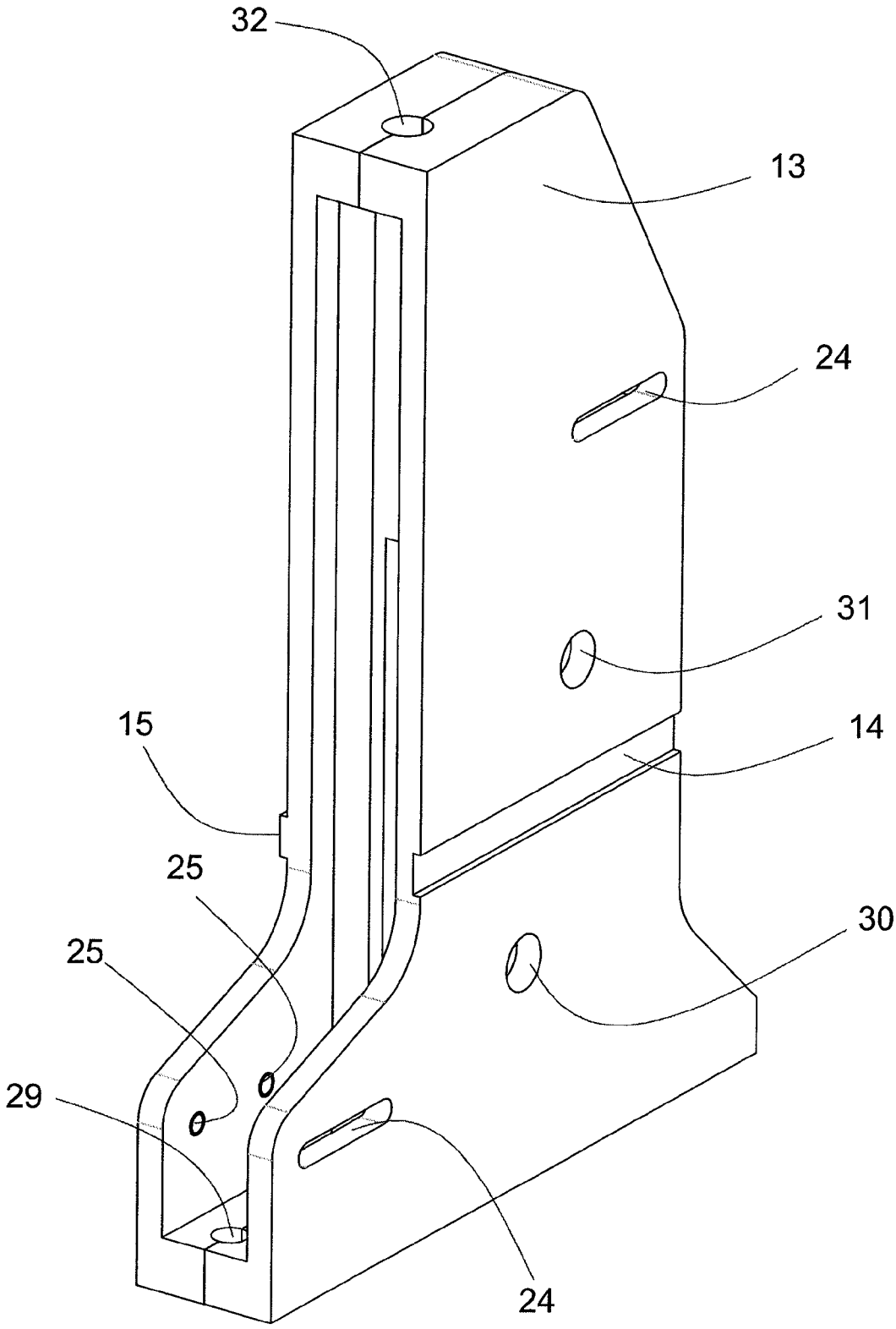
FIG. 8 is an enlarged perspective view of a deflecting element housing shown in FIGS. 4-7.
Figure 9:
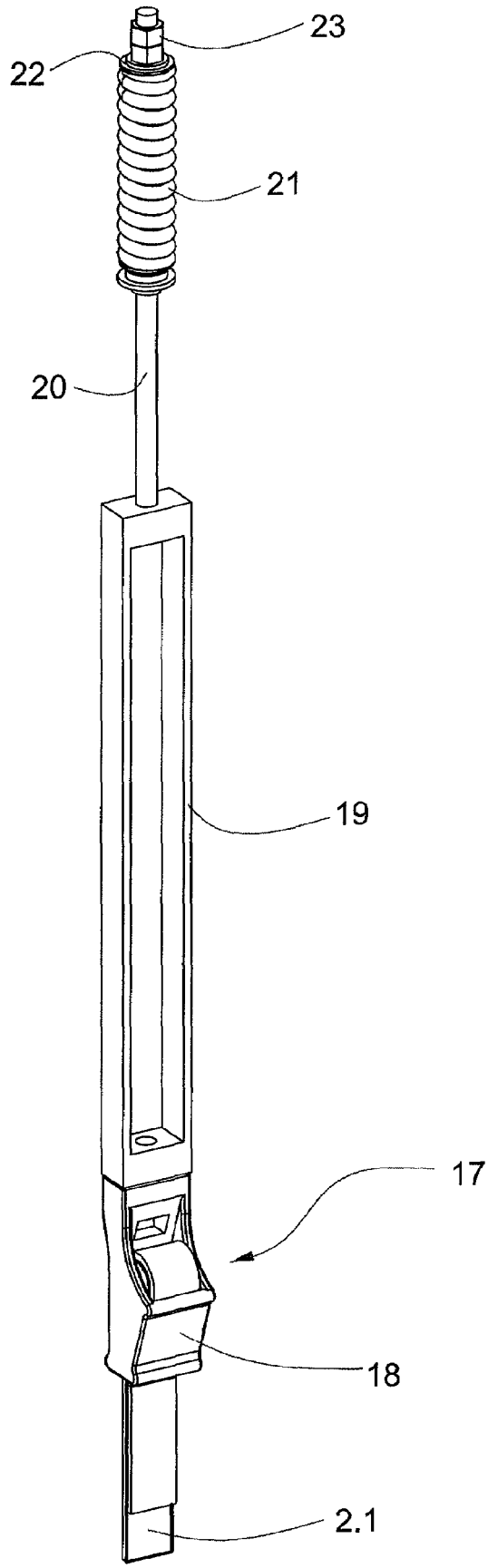
FIG. 9 is an enlarged perspective view of a support means end connection shown in FIGS. 4-7.

FIG. 8 shows details of the housing 13 with the groove 14 and the cog 15 as guides for displacement of the housings 13 relative to one another. Denoted by 30 and 31 are bores serving for reception of the axle of the deflecting roller 16.1 and the axle of the deflecting roller 16.2, respectively. A bore through which the threaded pin 20 is led is denoted by 32. The threaded pin 20 is connected, as shown in FIG. 9, with the yoke 19, at which in turn the support means fixing point 17 is arranged.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A deflecting module for an elevator for deflection of a support means supporting an elevator car and a counterweight, wherein the support means is guided by deflecting rollers which produce a change of direction of the support means, comprising:

a deflecting element for each associated support element of the support means, said deflecting elements mutually supporting one another to form the deflecting module; and at least one axle attached to each of said deflecting element, said at least one axle rotatably mounting one of the deflecting rollers for the associated support element of the support means.

2. The deflecting module according to claim 1 wherein each of said deflecting elements has a housing carried by a bearing plate and said housings are selectively displaceable relative to one another.

3. The deflecting module according to claim 1 wherein each said deflecting element through the deflecting roller mounted on said at least one axle provides a 2:1 or a 1:1 support means guidance.

4. The deflecting module according to claim 1 wherein each said deflecting element includes another axle mounting another one of the deflecting rollers providing a 4:1 support means guidance.

5. The deflecting module according to claim 2 wherein each said housing includes a groove, a cog, a slot and at least one bore to provide mutual displaceability of said deflecting elements.

6. The deflecting module according to claim 2 wherein each said housing includes a support means fixing point for fixing an end of each of the support elements of the support means.

7. The deflecting module according to claim 5 wherein said deflecting elements are connected by base plates, said base plates ensuring in accordance with a parallelogram principle that each said housings is displaceable by a same distance relative to an adjacent ones of said housing.

8. The deflecting module according to claim 6 wherein each said support means fixing point has a yoke extending into said housing, a support means end connection at one end of said yoke and said yoke being carried at another end by a threaded pin supported at said housing by a compensating spring.

9. An elevator installation comprising:

an elevator car;

a counterweight;

support means having a plurality of support elements connecting said elevator car with said counterweight for travel in an elevator shaft; and a deflecting module having a deflecting element associated with each said support element, each said deflecting element having at least one deflecting roller rotatably mounted thereon for changing a direction of said associated support element, said deflecting elements mutually supporting one another to form said deflecting module.

10. The elevator installation according to claim 9 wherein each said deflecting element through said at least one deflecting roller provides a 2:1 or a 1:1 support means guidance.

11. The elevator installation according to claim 9 wherein each said deflecting element includes another deflecting roller providing a 4:1 support means guidance.

12. A deflecting module for an elevator for deflection of a support means supporting an elevator car and a counterweight, wherein the support means is guided by deflecting rollers which produce a change of direction of the support means, comprising:

a deflecting element for each associated support element of the support means; and at least one axle attached to each of said deflecting element, said at least one axle rotatably mounting one of the deflecting rollers for the associated support element of the support means, wherein each of said deflecting elements has a housing carried by a bearing plate and said housings are selectively displaceable relative to one another, and wherein each said housing includes a groove, a cog, a slot and at least one bore to provide mutual displaceability of said deflecting elements.

13. The deflecting module according to claim 12 wherein said deflecting elements are connected by base plates, said base plates ensuring in accordance with a parallelogram principle that each said housings is displaceable by a same distance relative to an adjacent ones of said housing.

* * * * *